US010567876B2

(12) United States Patent
Tanoue

(10) Patent No.: US 10,567,876 B2
(45) Date of Patent: Feb. 18, 2020

(54) MICROPHONE UNIT AND AUDIO APPARATUS

(71) Applicant: Yamaha Corporation, Hamamatsu-shi, Shizuoka-Ken (JP)

(72) Inventor: Fumiyasu Tanoue, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 16/127,478

(22) Filed: Sep. 11, 2018

(65) Prior Publication Data

US 2019/0246206 A1 Aug. 8, 2019

Related U.S. Application Data

(63) Continuation of application No. PCT/JP2018/003955, filed on Feb. 6, 2018.

(51) Int. Cl.

| | |
|---|---|
| ***H04R 3/12*** | (2006.01) |
| ***H04R 1/32*** | (2006.01) |
| ***H04H 60/04*** | (2008.01) |
| ***H04R 1/04*** | (2006.01) |
| *G10H 1/36* | (2006.01) |

(52) U.S. Cl.

CPC ..... *H04R 3/12* (2013.01); *H04H 60/04* (2013.01); *H04R 1/04* (2013.01); *H04R 1/326* (2013.01); *G10H 1/361* (2013.01); *H04R 2499/13* (2013.01)

(58) Field of Classification Search

CPC ... H04R 3/12; H04R 1/32; H04R 1/04; H04H 60/04

USPC ..... 381/92, 122, 94.1, 111, 56, 91; 700/94

See application file for complete search history.

(56) References Cited

U.S. PATENT DOCUMENTS

2008/0199034 A1* 8/2008 Zhang ..... H04R 1/086 381/357

FOREIGN PATENT DOCUMENTS

| | | | | |
|---|---|---|---|---|
| JP | 6-75585 | A | | 3/1994 |
| JP | 06075585 | A | * | 3/1994 |
| JP | 2005-242057 | A | | 9/2005 |
| JP | 2009-81613 | A | | 4/2009 |
| JP | 2009081613 | A | * | 4/2009 |
| JP | 4999497 | B2 | | 8/2012 |

OTHER PUBLICATIONS

International Search Report (PCT/ISA/210) issued in PCT Application No. PCT/JP2018/003955 dated May 1, 2018 (three pages).

English Translation document C1 (International Search Report (PCT/ISA/210) previously filed on Sep. 11, 2018) (two (2) pages).

* cited by examiner

*Primary Examiner* — Melur Ramakrishnaiah

(74) *Attorney, Agent, or Firm* — Crowell & Moring LLP

(57) ABSTRACT

A microphone unit includes: a case having an interior space; a unidirectional microphone held in the interior space of the case; a first opening provided in the case; and a second opening provided in the case, wherein the first opening and the second opening are arranged opposite to each other across the microphone and are arranged in a straight line parallel to an axis of sensitivity of the microphone.

6 Claims, 8 Drawing Sheets

MICROPHONE UNIT AND AUDIO APPARATUS

CROSS REFERENCE TO RELATED APPLICATION

This application is a Continuation Application of PCT Application No. PCT/JP2018/003955, filed Feb. 6, 2018, the entire content of which is incorporated herein by reference.

BACKGROUND OF THE INVENTION

Field of the Invention

The present invention relates to a microphone unit and to an audio apparatus including a microphone.

Description of Related Art

Karaoke systems are well known in which a vocal signal of a user's singing voice received by a microphone and a musical accompaniment signal are mixed, and the resulting signal is supplied to speakers and output as sound. In in-vehicle karaoke systems, reduction of howling noise (undesirable audio feedback) is an important consideration. Japanese Patent Application Laid-Open Publication No. 2005-242057 discloses a technique in which bone conduction means is located in seats of a motor vehicle for reducing howling noise. Japanese Patent No. 4999497 discloses a technique in which directional speakers are oriented depending on the locations of seats in a motor vehicle.

However, if bone conduction means or directional speakers are used, the overall structure of the karaoke system will be extensive and complicated. In particular, if bone conduction means are used, the microphone should be located near the mouth of the user, and the user's head should be placed on the seat, constraining movement of the user.

SUMMARY OF THE INVENTION

With consideration of the above circumstances, it is an object of the present invention to achieve reduction of howling noise and simplify the structure of an audio apparatus.

According to a first aspect of the present invention, a microphone unit includes: a case having an interior space; a unidirectional microphone held in the interior space of the case; a first opening provided in the case; and a second opening provided in the case, in which the first opening and the second opening are arranged opposite to each other across the microphone and are arranged in a straight line parallel to an axis of sensitivity of the microphone.

According to a second aspect of the present invention, an audio apparatus includes: the microphone unit according to the first aspect of the present invention; and an audio processor configured to conduct signal processing on a signal output from the microphone unit for producing audio signals, and to supply the audio signals to the first speaker and the second speaker, in which the microphone unit is located at a position, a distance from a first speaker to the position being substantially equal to a distance from a second speaker to the position.

According to a third aspect of the present invention, an audio apparatus includes: the microphone unit according to the first aspect of the present invention; and an audio processor connected with a communication device, in which the communication device sends a first signal to an external apparatus including an external speaker and an external microphone, the first signal being supplied to the external speaker, and the communication device receives a second signal from the external apparatus, with the second signal being output from the external microphone. The microphone unit is located at a position, a distance from a first speaker to the position being substantially equal to a distance from a second speaker to the position, and the audio processor is configured to: conduct signal processing on a signal output from the microphone unit for producing an audio signal; supply the audio signal as the first signal to the communication device; conduct signal processing on the second signal supplied from the communication device for producing a first audio signal and a second audio signal that is in-phase with the first audio signal; supply the first audio signal to the first speaker; and supply the second audio signal to the second speaker.

DESCRIPTION OF THE EMBODIMENT

Embodiment

Figure 1:
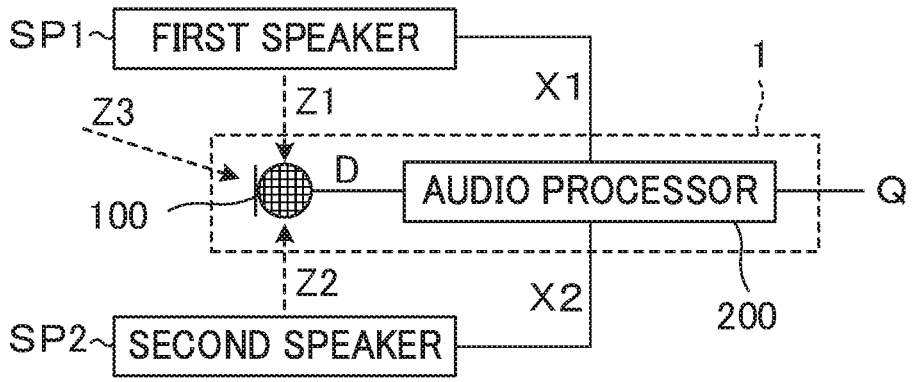
FIG. 1 is a block diagram showing a configurational example of an audio apparatus according to an embodiment.

With reference to the accompanying drawings, an embodiment according to the present invention will be described. In the drawings, the dimensions and scale of each element are not necessarily as shown. The embodiment described below are preferable specific examples of the present invention, so that the present embodiment includes technically preferable limitations. However, the scope of the present invention is not limited to the embodiment unless otherwise stated to limit the present invention in the following description.

FIG. 1 is a block diagram showing a configurational example of an audio apparatus 1 according to the present embodiment. The audio apparatus 1 is an apparatus, together with an in-vehicle car stereo system and speakers, for realizing an in-vehicle karaoke system. The audio apparatus 1 includes a microphone unit 100 for receiving singing vocals of users of the in-vehicle karaoke system, and an audio processor 200 for conducting signal processing on the output signal D of the microphone unit 100. The microphone unit 100 and the audio processor 200 are electrically connected to each other via a signal line, such as an audio cable.

Figure 2:
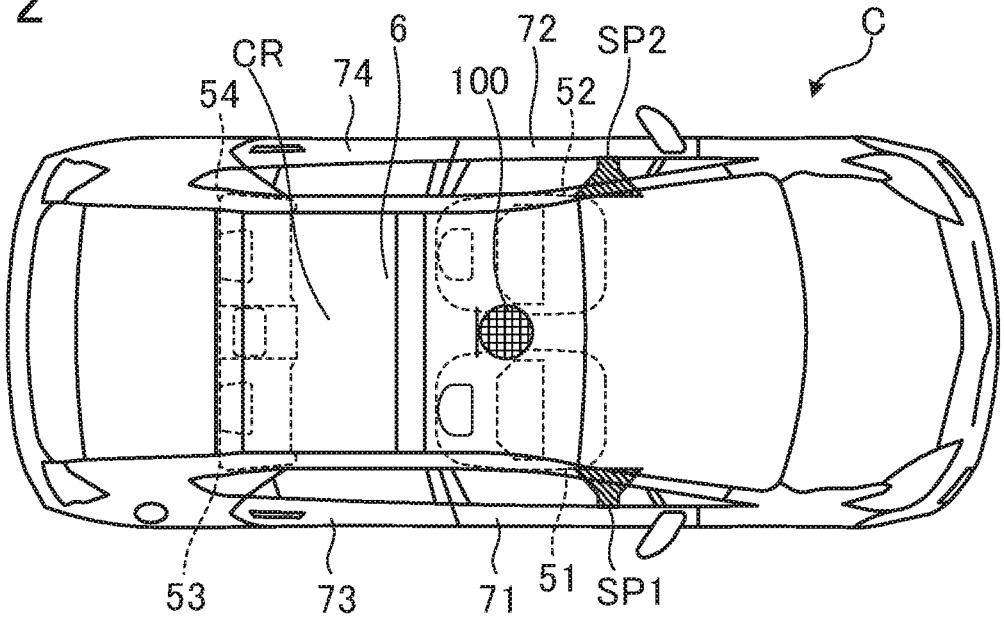
FIG. 2 is a plan view of a vehicle in which the audio apparatus is mounted.
Figure 3:
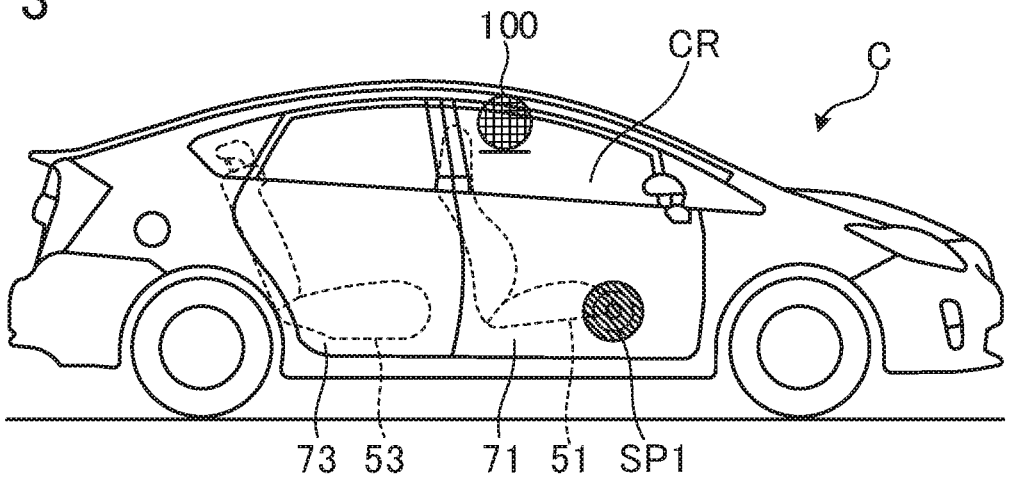
FIG. 3 is a side view of the vehicle in which the audio apparatus is mounted.

FIG. 2 is a plan view of a vehicle C on which the audio apparatus 1 is mounted, and FIG. 3 is a side view of the vehicle C. In the passenger compartment CR of the vehicle C, four seats 51-54 arranged in a rectangular manner, a ceiling 6, a front right door 71, a front left door 72, a rear right door 73, a rear left door 74, a first speaker SP1, and a second speaker SP2 are located in addition to the audio apparatus 1. If the vehicle C is made for the Japanese or British market, the seat 51 is the driver seat, and the seat 52 is the front passenger seat. However, if the vehicle C is made for the US or Continental market, the seat 51 is the front passenger seat, and the seat 52 is the driver seat. In the following description, it is assumed that the vehicle C is for the Japanese or British market. The seat 53 is the right rear seat, whereas the seat 54 is the left rear seat. Each of the seats 51-54 is made of cloth or leather, and can absorb sound. The seats 51-54 are oriented in the same direction.

Each of the first speaker SP1 and the second speaker SP2 is a door speaker. The first speaker SP1 is arranged in the front right door 71 such that the sound emission surface is oriented toward the seat 51. The second speaker SP2 is arranged in the front left door 72 such that the sound emission surface is oriented toward the seat 52. Although detailed illustration is omitted in FIGS. 2 and 3, each of the first speaker SP1 and the second speaker SP2 is connected to the audio processor 200 of the audio apparatus 1 via a signal line, such as an audio cable. Although illustration of the audio processor 200 is omitted in FIGS. 2 and 3, the audio processor 200 is located in the console of the driver's side in the vehicle C.

The microphone unit 100 of the audio apparatus 1 converts the received sound into an audio signal, and supplies the audio signal to the audio processor 200. The microphone unit 100 is located, such that the distance between the microphone unit 100 and the first speaker SP1 is substantially equal to the distance between the microphone unit 100 and the second speaker SP2. In the present embodiment, the microphone unit 100 is located in the vicinity of the compartment lamp (not shown in FIGS. 2 and 3) on the ceiling 6 of the passenger compartment CR.

The audio processor 200 is, for example, a DSP (Digital Signal Processor). As shown in FIG. 1, the output signal D of the microphone unit 100 is given to the audio processor 200, and an accompaniment signal for karaoke is given as an external signal Q to the audio processor 200 from a music playback apparatus (not shown in FIGS. 2 and 3) of the car stereo system. A specific example of the music playback apparatus is a CD player. The audio processor 200 conducts signal processing on the output signal D supplied from the microphone unit 100 and the external signal Q, and supplies the first audio signal X1 to the first speaker SP1 and supplies the second audio signal X2 to the second speaker SP2. The second audio signal X2 is in-phase with the first audio signal X1. In other words, the audio processor 200 produces the first audio signal X1 and the second audio signal X2, between which there is no phase difference, and supplies them to the speakers. The first audio signal X1 supplied from the audio processor 200 to the first speaker SP1 and the second audio signal X2 supplied from the audio processor 200 to the second speaker SP2 may be either monaural signals or stereo signals. Signal processing conducted by the audio processor 200 may include, for example, amplifying the output signal D from the microphone unit 100, adding an acoustic effect, such as reverberation, to the output signal D, and/or mixing the output signal D and the external signal Q.

The microphone unit 100 shown in FIG. 1 is used for receiving singing vocals Z3 of a singer who sings a karaoke song in the passenger compartment CR, but also receives a sound Z1 output from the first speaker SP1 and a sound Z2 output from the second speaker SP2. The output signal D from the microphone unit 100 is subjected to signal processing by means of the audio processor 200, and is then supplied to each of the first speaker SP1 and the second speaker SP2. In the in-vehicle karaoke system having the audio apparatus 1, the sound Z1 output from the first speaker SP1 and the sound Z2 output from the second speaker SP2 return to the first speaker SP1 and the second speaker SP2 via the microphone unit 100 and the audio processor 200. Therefore, howling noise may occur. However, in the present embodiment, the microphone unit 100 has a bidirectional characteristic. In addition, as described above, the distance from the first speaker SP1 to the microphone unit 100 is substantially equal to the distance from the second speaker SP2 to the microphone unit 100. Therefore, the sound Z1 and the sound Z2 are canceled at the diaphragm of the microphone 3 shown in FIG. 8, as will be described later. On the other hand, the user sings vocals sitting on the seat 51 or 52. Accordingly, the user's sung vocals Z3 is received by the microphone unit 100. The output signal D from the microphone unit 100 involves the user's singing vocals Z3. The output signal D is mixed with the external signal Q, and it is then supplied as the first audio signal X1 to the first speaker SP1, and is supplied as the second audio signal X2 to the second speaker SP2. However, since the sound Z1 and the sound Z2 are canceled at the diaphragm of the microphone 3, howling noise can be reduced.

Figure 4:
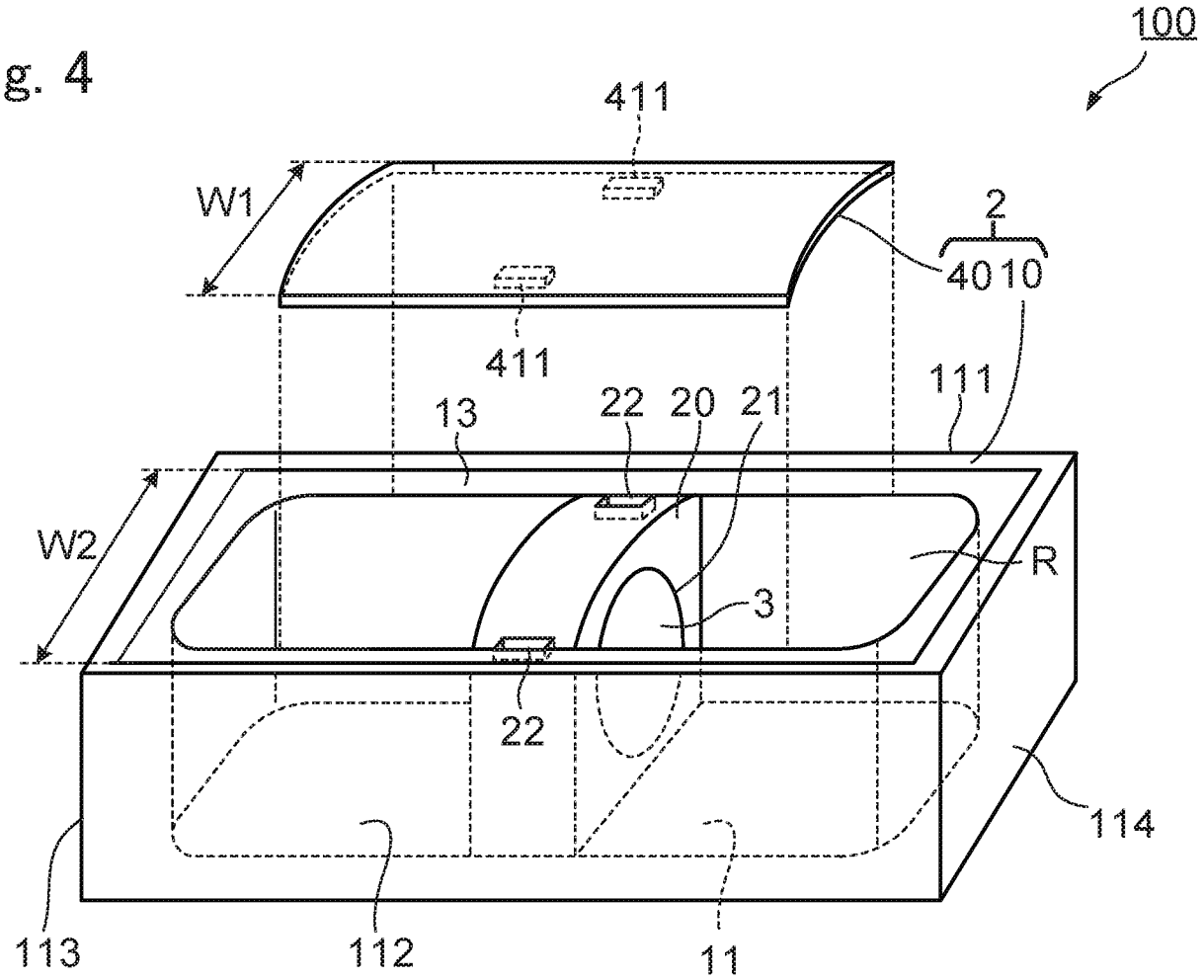
FIG. 4 is an exploded perspective view of a microphone unit of the audio apparatus.

In the following, the structure of the microphone unit 100 that reduces howling noise will be focused on. FIG. 4 is an exploded perspective view of the microphone unit 100 according to the present embodiment. As shown in FIG. 4, the microphone unit 100 has a substantially rectangular parallelepiped shape. The microphone unit 100 includes a case 2 and a microphone 3. The case 2 is a part of the microphone unit 100 excluding the microphone 3.

The case 2 includes a main body 10 and a lid 40. Each of the main body 10 and the lid 40 may be made of, for example, a resin, such as ABS (acrylonitrile butadiene styrene), by means of integral molding. The main body 10 is of a substantially box shape. The main body 10 has a bottom part 11 and a wall part surrounding the peripheries of the bottom part 11. The wall part includes a first wall 111, a second wall 112, a third wall 113, and a fourth wall 114. The first wall 111 faces the second wall 112, whereas the third wall 113 faces the fourth wall 114. In this example, the first wall 111, the second wall 112, the third wall 113, and the fourth wall 114 have the same height, and are provided perpendicular to the bottom part 11. A groove 13 is formed on the inner peripheries on the side of the lid 40 of the first wall 111, the second wall 112, the third wall 113, and the fourth wall 114. As shown in FIG. 4, the width W1 of the lid 40 is substantially equal to the length W2 from the groove 13 of the first wall 111 to the groove 13 of the second wall 112 in the main body 10. The lid 40 can be fitted into the groove 13.

The main body 10 includes a holder 20 for holding the microphone 3 between the first wall 111 and the second wall 112. The holder 20 has a through-hole 21. The through-hole 21 is of a circular cross section, into which a cylindrical microphone 3 is engaged. Although not illustrated in FIG. 4, the main body 10 has a through-hole through which the signal line connecting the microphone 3 and the audio processor 200 passes to the exterior. The holder 20 holds the microphone 3, and separates the space (i.e., the interior space) defined by the bottom part 11 and the wall part into two spaces.

The side of the holder 20 facing the lid 40 is a curved surface that matches the curvature of the reverse side of the lid 40. More specifically, the curvature radius of the reverse side of the lid 40 is substantially equal to the curvature radius of the top section of the holder 20. As shown in FIG. 4, two holes 22 are formed at the side of the holder 20 facing the lid 40, whereas two hooks 411 are formed at the reverse side of the lid 40 and can be engaged within the holes 22. In the present embodiment, the lid 40 is fixed to the main body 10 by engaging the hooks 411 within the holes 22.

Figure 5:
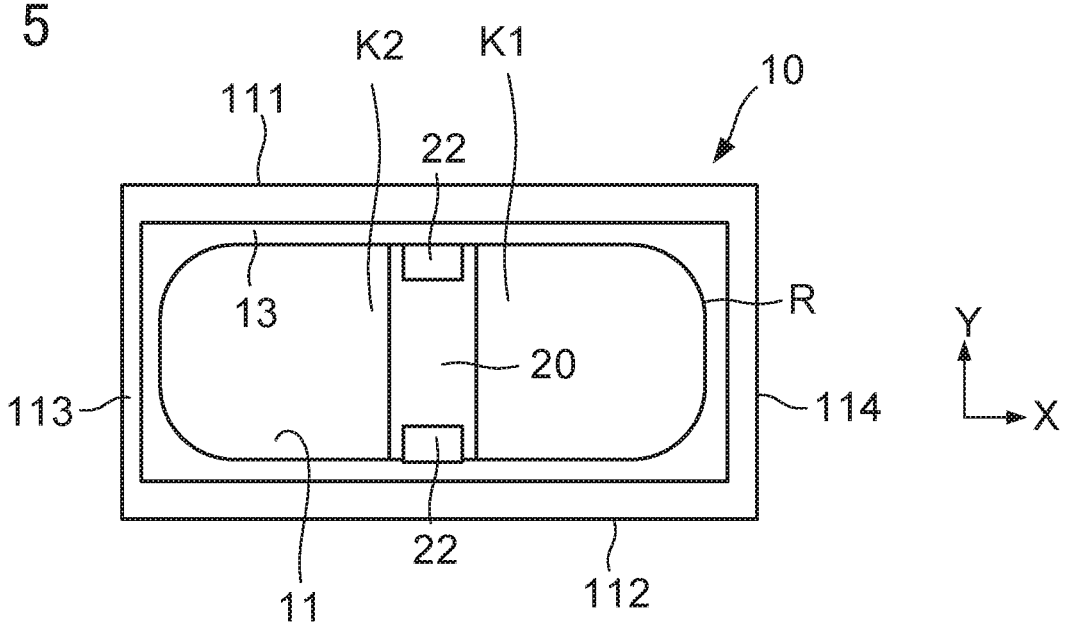
FIG. 5 is a plan view of a main body of a case of the microphone unit.

FIG. 5 is a plan view of the main body 10. In FIG. 5, the longitudinal direction of the main body 10 is the X direction, whereas the width direction of the main body 10 is the Y direction. As shown in FIGS. 4 and 5, the main body 10 includes an opening R (an example of "third opening") that opens at the side opposite to the bottom part 11. The length of the opening R in the X direction is greater than the length of the lid 40 in the X direction. The interior space of the main body 10 defined by the first wall 111, the second wall 112, the third wall 113, the fourth wall 114, and the bottom part 11 is substantially equally divided by the holder 20 into an interior space K1 and an interior space K2.

Figure 6:
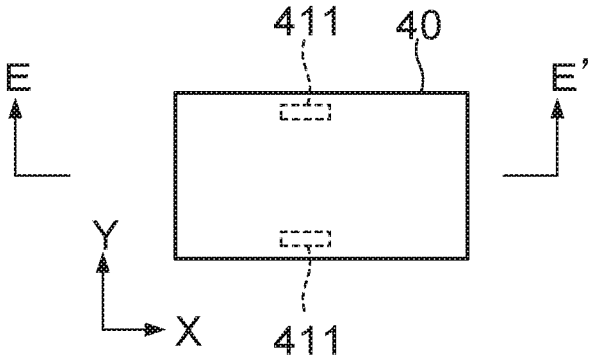
FIG. 6 is a plan view of a lid of the case.
Figure 7:
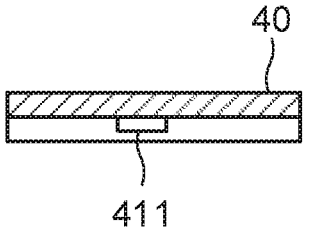
FIG. 7 is a cross-sectional view of the lid.

FIG. 6 is a plan view of the lid 40, whereas FIG. 7 is a cross-sectional view of the lid 40 taken along lines E-E'. In FIG. 6, the longitudinal direction of the lid 40 is the X direction, whereas the width direction of the lid 40 is the Y direction. Two hooks 411 projects from the reverse side of the lid 40 toward the main body 10. The height of the hooks 411 is shorter than the depth of the holes 22, so that the lid 40 does not rise from the holder 20 in a case in which the hooks 411 are engaged within the holes 22. The lid 40 covers a part of the opening R of the main body 10, and is in contact with the holder 20.

Figure 8:
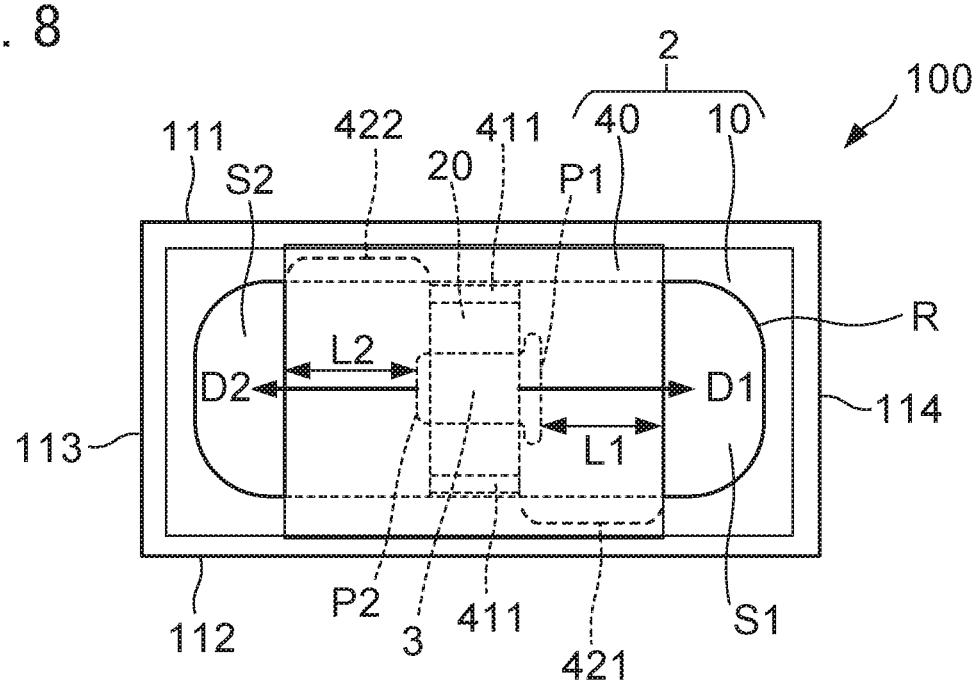
FIG. 8 is a plan view of the microphone unit.

FIG. 8 is a plan view of the microphone unit 100. The microphone 3 converts sound into an electric signal, and outputs it as an audio signal. The microphone 3 may be any one of a moving coil type, a ribbon type, and a capacitor type, but in the present embodiment, an electret condenser microphone is used as the microphone 3. The microphone 3 includes a diaphragm and an electret element. In the microphone 3, a capacitor is constituted by the diaphragm and the electret element, and the diaphragm vibrates in response to sound waves, so that the distance between the diaphragm and the electret element varies, whereby the capacitance of the capacitor varies. The microphone 3 outputs the varying capacitance value as an audio signal.

As shown in FIG. 8, the top surface of the case 2 of the microphone unit 100 is provided with a first opening S1 and a second opening S2. The first opening S1 is a part of the opening R and is a gap between the fourth wall 114, which is a first side of the walls in the longitudinal direction of the main body 10, and the lid 40. The second opening S2 is also a part of the opening R and is a gap between the third wall 113, which is a second side of the walls in the longitudinal direction of the main body 10, and the lid 40. The first opening S1 is surrounded by the first wall 111, the second wall 112, the fourth wall 114, and the lid 40. The second opening S2 is surrounded by the first wall 111, the second wall 112, the third wall 113, and the lid 40.

In the following, the side of the microphone 3 facing the fourth wall 114 is called a first side P1, whereas the side of the microphone 3 facing the third wall 113 is called a second side P2. The direction from the first side P1 toward the fourth wall 114 is called a first direction D1, whereas the direction, which is opposite to the first direction D1, from the second side P2 toward the third wall 113, is called a second direction D2. The length of a spreading section 421 of the lid 40 that spreads out of the microphone 3 in the first direction D1 is called L1. The length L1 is the distance between the first side P1 of the microphone 3 and the right edge of the lid 40. The length of another spreading section 422 of the lid 40 that spreads out of the microphone 3 in the second direction D2 is called L2. The length L2 is the distance between the second side P2 of the microphone 3 and the left edge of the lid 40. In the present embodiment, the length L1 is substantially equal to the length L2. That is to say, the distance from the first opening S1 to the first side P1 of the microphone 3 is substantially equal to the distance from the second opening S2 to the second side P2 of the microphone 3.

The microphone 3 in the present embodiment is a unidirectional microphone sensitive to sounds along the first direction D1 although the entire microphone unit 100 has a bidirectional characteristic as described later. The first opening S1 and the second opening S2 in the case 2 are arranged opposite to each other across the microphone 3 and are arranged in a straight line along the sensitive axis of the microphone 3. In the following, reasons for adopting the unidirectional microphone in the microphone unit 100 will be described together with experiments conducted by the inventor.

Experiment 1

The inventor conducted an experiment in which the difference between the phase of sound received by the microphone unit 100 and the phase of audio signal output from the microphone unit 100 was measured while the receiving direction of sound for the microphone unit 100 is varied.

Figure 9:
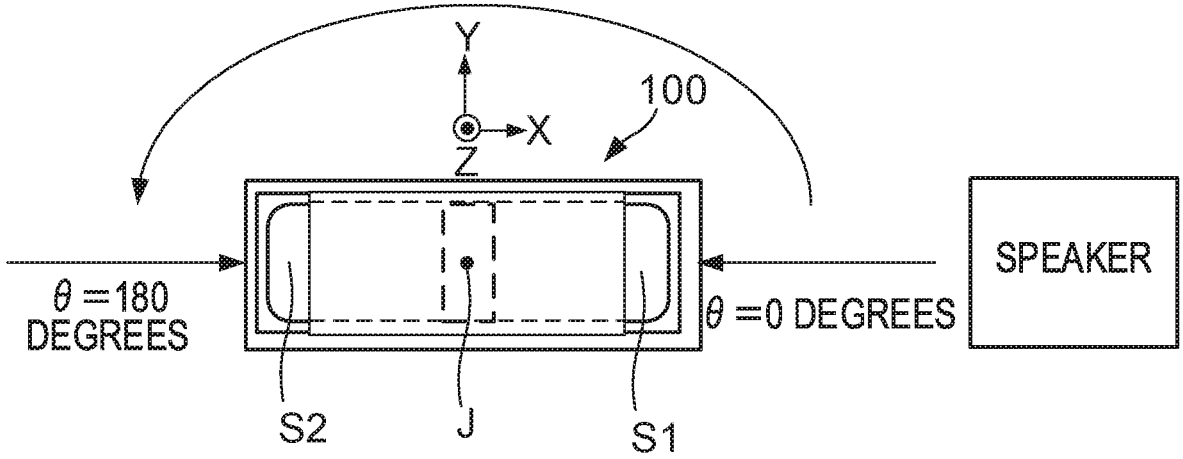
FIG. 9 is a view showing experiments for measuring phase differences.

The origin of XYZ coordinates in FIG. 9 is the location of the microphone unit 100 in this experiment, and the X direction is the longitudinal direction of the microphone unit 100, whereas the Y direction is the width direction of the microphone unit 100. A speaker was located in the positive direction of the X axis and apart from the microphone unit 100 with a predetermined distance. The positive direction of the X axis is the first direction D1 shown in FIG. 8. The location of the speaker was fixed, and the microphone unit 100 was rotatable on the XY plane about an axis passing a point J that is parallel to the Z axis.

First of all, the orientation of the microphone unit 100 was set so that the receiving direction for the microphone unit 100 of the sound from the speaker is zero degrees. In this state, the phase difference was measured while the frequency of the sound emitted from the speaker toward the microphone unit 100 was changed to 100, 300, 400, 600, 800, 1000, 1500, 2000, and 2500 Hz.

Then, the microphone unit 100 was rotated on the XY plane such that the receiving direction for the microphone unit 100 of the sound from the speaker was 30, 60, 90, 100, 110, 120, 150, and 180 degrees. At each receiving direction, the phase difference was measured while the frequency of the sound emitted from the speaker toward the microphone unit 100 was changed to 100, 300, 400, 600, 800, 1000, 1500, 2000, and 2500 Hz in the same manner as for the case in which the receiving direction is zero degrees. The results of the experiment are shown in FIG. 10.

Figure 10:
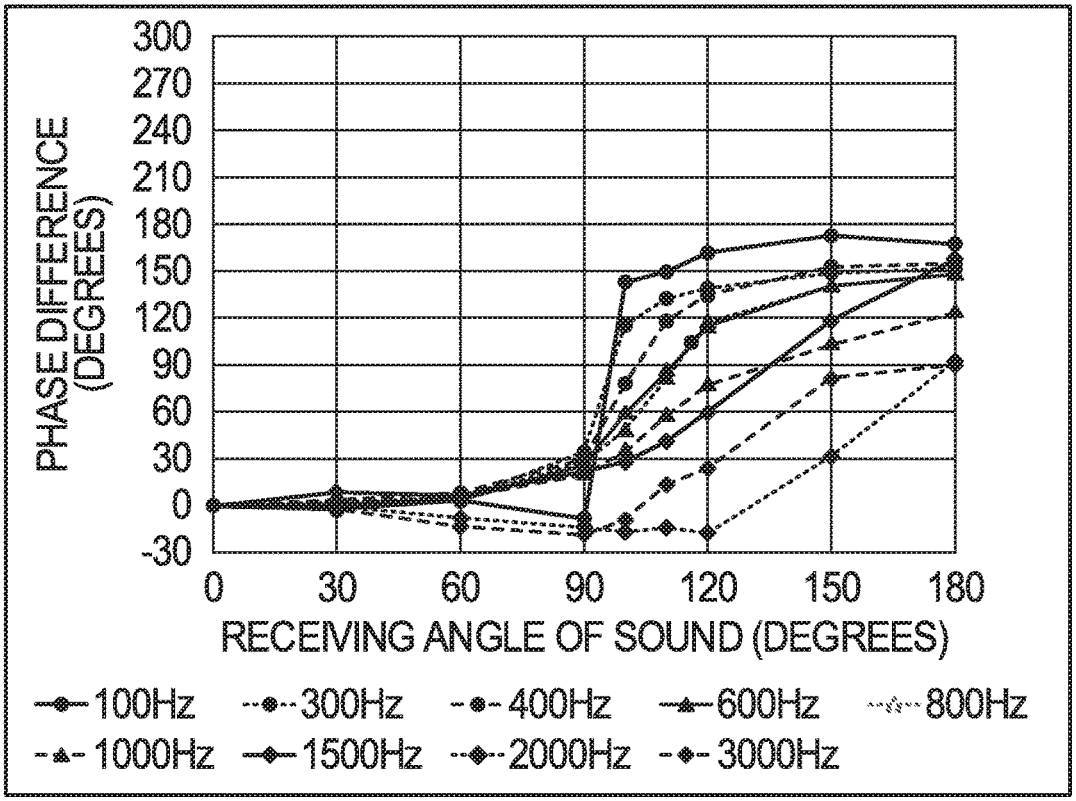
FIG. 10 is a graph showing results of an experiment in which a unidirectional microphone according to the embodiment is used.

As is apparent from FIG. 10, the difference between the phase of sound received by the microphone unit 100 and the phase of an audio signal output from the microphone unit 100 was zero degrees when the receiving angle of sound for the microphone unit 100 was zero degrees. The greater the receiving angle, the greater the phase difference. Each time the receiving angle was changed from 30 degrees, 60 degrees, and then to 90 degrees, the phase difference was greater within plus/minus 30 degrees. When the receiving angle was in excess of 90 degrees, the phase difference was much greater. When the receiving angle was 180 degrees, the phase difference was from 90 degrees to 150 degrees. It is remarkable that although the microphone 3 is a unidirectional microphone sensitive to sounds coming along the first direction D1 (the receiving angle is zero degrees), the entire microphone unit 100 was sensitive to sounds coming along the second direction D2 (the receiving angle is 180 degrees) so that there was a large phase difference. The microphone unit 100 behaved as if it is a bidirectional microphone. The reason is thought to be that in the microphone unit 100, sound coming along the second direction D2 is introduced through the second opening S2 of the case 2 into the interior space K2, and then is diffracted via the gap between the lid 40 and the holder 20 to the interior space K1.

In the vehicle C in which the audio apparatus 1 is provided, assume that the first speaker SP1 is oriented at a position where the receiving angle for the microphone unit 100 is 0 degrees, and that the second speaker SP2 is oriented at a position where the receiving angle for the microphone unit 100 is 180 degrees. In this case, the phase difference between the sound output from the first speaker SP1 and the audio signal output from the microphone unit 100 in response to the sound is 0 degrees, and the phase difference between the sound output from the second speaker SP2 and the audio signal output from the microphone unit 100 in response to the sound is 90 to 150 degrees.

As described above, in the present embodiment, the microphone unit 100 is located, such that the distance between the microphone unit 100 and the first speaker SP1 is substantially equal to the distance between the microphone unit 100 and the second speaker SP2, so that the first speaker SP1 and the second speaker SP2 output signals that are in-phase with each other. Accordingly, in the present embodiment, the difference between the phase of the sound output from the first speaker SP1 and the phase of the sound output from the second speaker SP2 on the diaphragm of the microphone 3 is 90 to 150 degrees, and thus, the sound output from the first speaker SP1 and the sound output from the second speaker SP2 are canceled on the diaphragm of the microphone 3 depending on the phase difference. As a result, the main signal component of the output signal D from the microphone unit 100 is the signal component corresponding to the singing voice of the user of the in-vehicle karaoke system. In the above context, "the distance between the microphone unit 100 and the first speaker SP1 is substantially equal to the distance between the microphone unit 100 and the second speaker SP2" does not mean to require the distances being completely the same, but rather means that the microphone unit 100 is located such that the sound output from the first speaker SP1 and the sound output from the second speaker SP2 are at least partially canceled at the bidirectional microphone unit 100. For example, the ratio of the distance from the first speaker SP1 to the microphone unit 100 to the distance from the second speaker SP2 to the microphone unit 100 is preferably from 80% to 120%.

Thus, the sound output from the first speaker SP1 and the sound output from the second speaker SP2 are partially or completely canceled at the diaphragm of the microphone unit 100. Therefore, whereas the audio signal resulting from mixing the output signal D from the microphone unit 100 and the external signal Q is given to each of the first speaker SP1 and the second speaker SP2, howling noise can be reduced. According to the result of another experiment conducted by the inventor, it was found that if the difference between the phase of the sound of which the receiving angle is zero degrees and the phase of the sound of which the receiving angle is 180 degrees is within 150 to 210 degrees, effects for reduction of howling noise can be obtained.

The inventor also conducted the same experiment for a bidirectional microphone instead of the microphone unit 100. Specifically, the difference between the phase of sound received by the bidirectional microphone and the phase of audio signal output from the bidirectional microphone was measured with the receiving direction of sound for the bidirectional microphone being varied. More specifically, the inventor measured the phase difference while the frequency of the sound emitted from the speaker toward the bidirectional microphone was changed to 100, 250, 500, 1000, and 2500 Hz. The results of the experiment are shown in FIG. 11.

Figure 11:
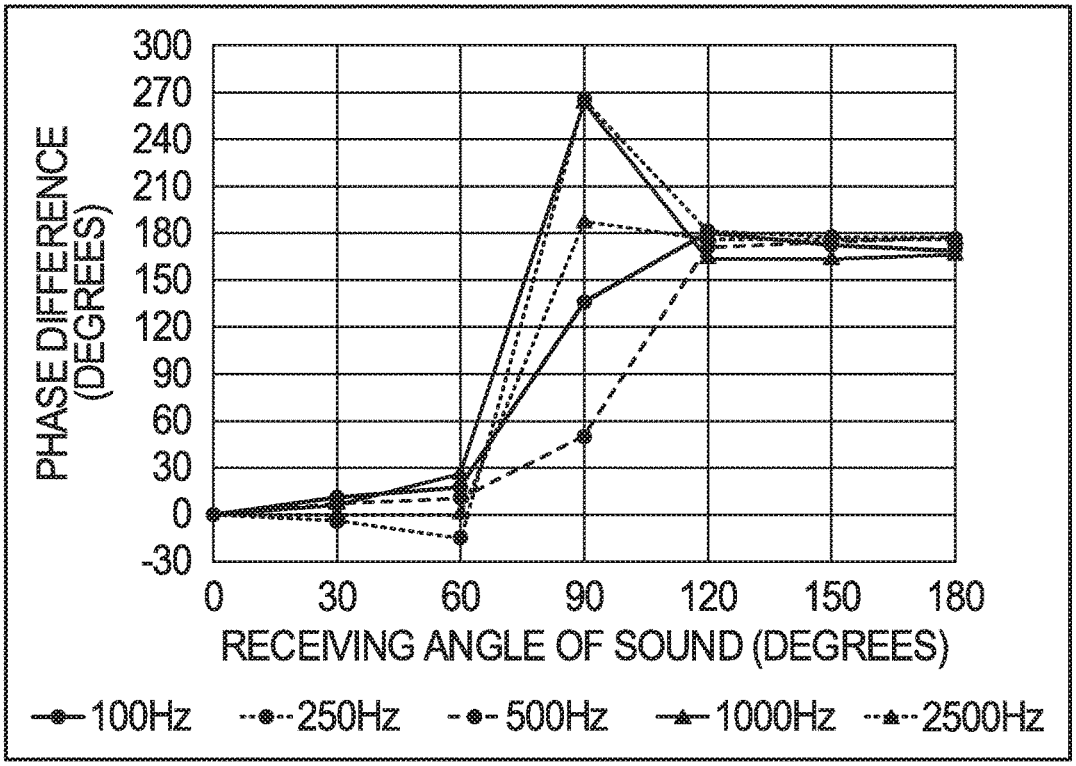
FIG. 11 is a graph showing results of an experiment in which a bidirectional microphone is used.

As is apparent from FIG. 11, the phase difference was zero degrees when the receiving angle of sound for the bidirectional microphone was zero degrees. The greater the receiving angle, the greater the phase difference, similar to for the microphone unit 100. When the receiving angle was 90 degrees or more, the steep increase in the phase difference was observed. When the receiving angle was 120 degrees or more, the phase difference was almost 180 degrees and constant. This is because the bidirectional microphone is also sensitive to sounds of which the receiving angle is 180 degrees.

According to the results shown in FIG. 11, it is contemplated that if in-phase sounds are emitted, such that the receiving angles for the bidirectional microphone are zero degrees and 180 degrees, the sounds will be canceled completely at the diaphragm of the bidirectional microphone. Therefore, it is expected that if the first speaker SP1 and the second speaker SP2 emit in-phase sounds to the bidirectional microphone in place of the microphone unit 100 in the audio apparatus 1, howling noise will be further reduced in comparison with the microphone unit 100.

However, according to another experiment conducted by the inventor, it was found that better sound can be obtained, in particular, in a low pitch range with the use of the microphone unit 100. The reason is thought to be that the many obstacles, such as the seat 51 and the driver sitting thereon, that will affect sound transmission, are interposed between the first speaker SP1 and the microphone unit 100 in the direction in which the receiving angle for the microphone unit 100 is zero degrees, and that low pitch sounds are likely diffracted by the obstacles and are likely influenced by the obstacles in the passenger compartment CR. Since a better sound can thus be obtained in a low pitch range in comparison with the bidirectional microphone, the present embodiment adopts the microphone unit 100 in which a unidirectional microphone 3 is contained in a particular case 2 for having the bidirectional characteristic.

Experiment 2

Figure 12:
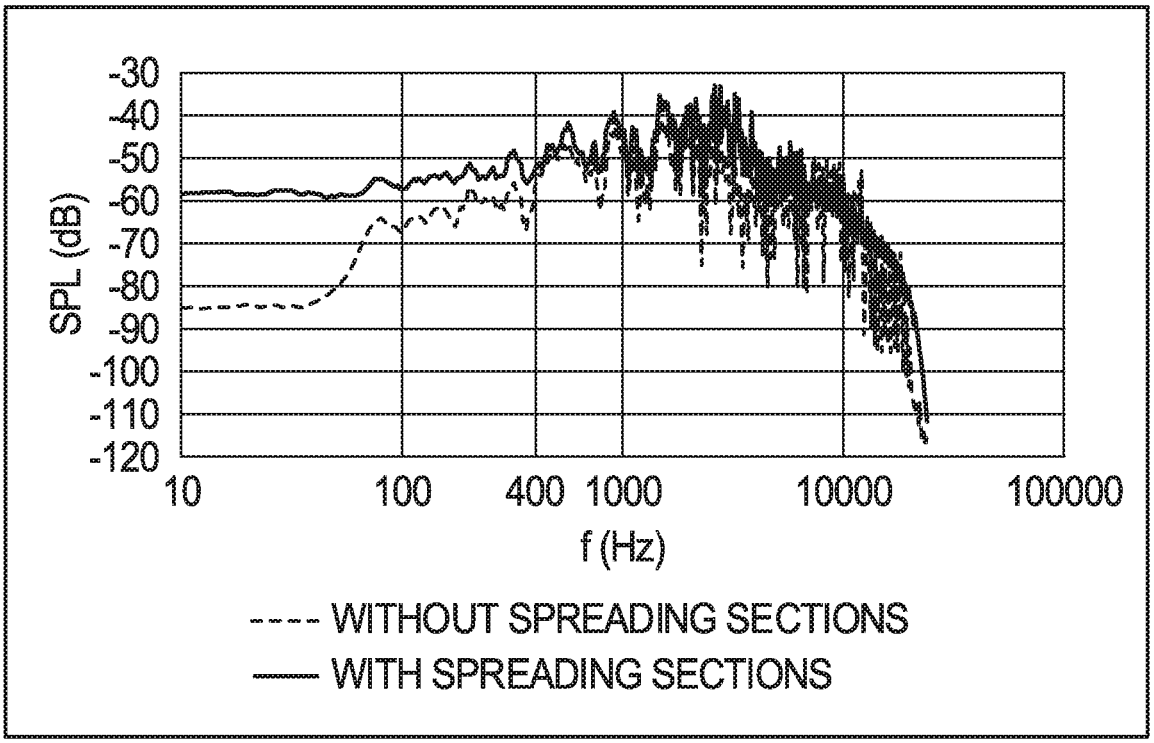
FIG. 12 is a graph showing results of an experiment for measuring frequency characteristics for determining effects of the microphone unit according to the embodiment.

The inventor conducted an experiment for determining the effect of the spreading sections 421 and 422 on the output signal D from the microphone unit 100. More specifically, the inventor measured frequency characteristics of the output signal D of the microphone unit 100, which has the spreading sections 421 and 422 and frequency characteristics of the output signal D of another microphone unit 100 that does not have the spreading sections 421 and 422. The frequency range was 10 to 20000 Hz including the audible band. The results of the experiment are shown in FIG. 12. In the comparison microphone unit 100 without the spreading sections, the lid 40 was formed in such a manner that L1=L2=0.

As shown in FIG. 12, at frequencies higher than 400 Hz, the sound pressure level of the output signal D from the microphone unit 100 with the spreading sections 421 and 422 was generally equal to the sound pressure level of the output signal D from the comparison microphone unit 100 without the spreading sections 421 and 422. However, at frequencies lower than 400 Hz, the former sound pressure level was higher than the latter. The reason is thought to be that in the microphone unit 100 with the spreading sections 421 and 422, the spreading sections 421 and 422, the holder 20, the bottom part 11, and the wall part vertically aligned to the bottom part 11 form Helmholtz resonators, in which the sound pressure level of sound in frequencies lower than 400 Hz is emphasized by the resonance.

More specifically, it is considered that there is formed in the microphone unit 100 a Helmholtz resonator in which the section of interior space K1 covered with the spreading section 421 serves as the resonator cavity, and in which the first opening S1 serves as the resonator neck. Similarly, it is considered that there is also formed in the microphone unit 100 another Helmholtz resonator in which the section of interior space K2 covered with the spreading section 422 serves as the resonator cavity, and in which the second opening S2 serves as the resonator neck. Then, it is considered that the Helmholtz resonators strengthen the sound pressure level of sound in frequencies lower than 400 Hz. In the present embodiment, the microphone unit 100 includes the spreading sections 421 and 422, so that the low pitch sound components with frequencies lower than 400 Hz in the output signal D from the microphone unit 100 are increased.

Experiment 3

The inventor conducted another experiment for determining a preferable length of the spreading sections 421 and 422. In other words, the inventor measured sound pressure levels of the output signal D of the microphone unit 100 while the length L1 of the spreading section 421 and the length L2 of the spreading section 422 were changed to 5, 7, 10, 15, and 20 mm, while the frequency of sound emitted to the microphone unit 100 was changed to 100 Hz and 200 Hz. The results of the experiment are shown in FIGS. 13 and 14.

Figure 13:
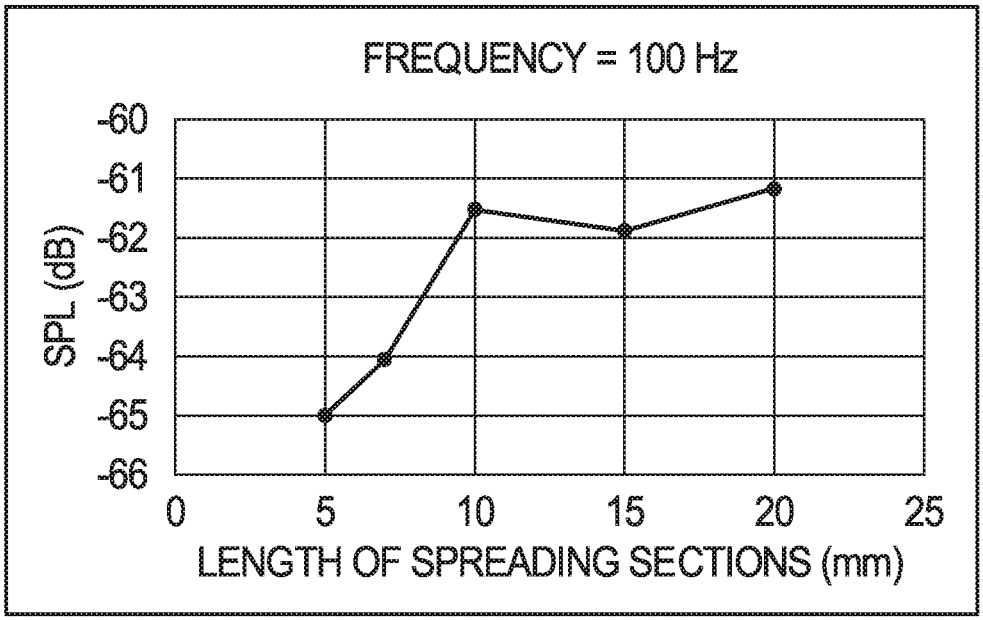
FIG. 13 is a graph showing effects of spreading sections in the microphone unit.
Figure 14:
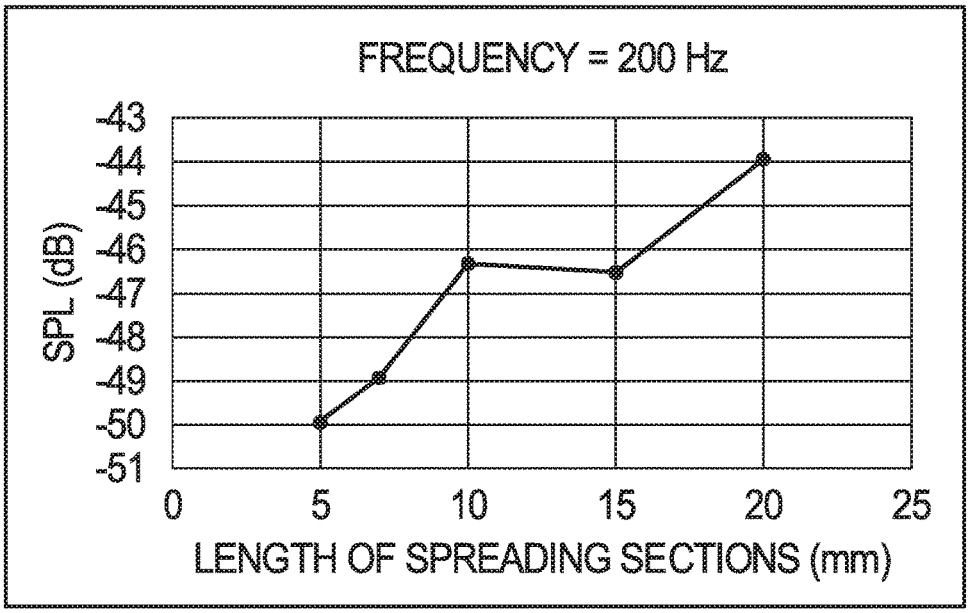
FIG. 14 is another graph showing effects of spreading sections in the microphone unit.

FIG. 13 is a graph showing the measurement result for the frequency of sound is 100 Hz, whereas FIG. 14 is a graph showing the measurement result for the frequency of sound is 200 Hz. As is apparent from FIGS. 13 and 14, for both sounds with the frequency of 100 Hz and 200 Hz, as long as the length of the spreading sections 421 and 422 is 5 to 10 mm, the longer the spreading sections 421 and 422 are, the higher the sound pressure level of the output signal of the microphone unit 100. As long as the length of the spreading sections 421 and 422 is 10 to 15 mm, the sound pressure level of the output signal D from the microphone unit 100 is constant. If the length of the spreading sections 421 and 422 is greater than 15 mm, again, the longer the spreading sections 421 and 422 are, the higher the sound pressure level of the output signal of the microphone unit 100.

Therefore, the spreading sections 421 and 422 in the microphone unit 100 are preferably as long as possible, preferably at least 5 mm. In the microphone unit 100, the volume of the cavities of the Helmholtz resonators is determined depending on the length of the spreading sections 421 and 422. If the length of the spreading sections 421 and 422 is not sufficient, i.e., if the volume of the cavities is not sufficient, it is contemplated that the Helmholtz resonance does not occur. Accordingly, it is contemplated that longer spreading sections 421 and 422 are more acoustically preferable. However, if the spreading sections 421 and 422 are lengthened, the microphone unit 100 is inevitably large and will be difficult to place near the compartment lamp. Taking account of the arrangement of the microphone unit 100 in the vicinity of the compartment lamp, it is considered that the length of the spreading sections 421 and 422 is preferably about 20 mm at the maximum.

As described above, according to the audio apparatus 1 of the present embodiment, whereas the audio signal resulting from mixing the output signal D from the microphone unit 100 and the external signal Q is given to each of the first speaker SP1 and the second speaker SP2, howling noise can be reduced. In addition, in accordance with the present embodiment, movement of the user is not constrained, e.g., the user is not forced to place the user's head onto the seat. Furthermore, the present embodiment provides a better sound in comparison with a bidirectional microphone. That is to say, by virtue of the present embodiment, howling noise can be reduced, the structure of the audio apparatus 1 can be simplified, and low pitch sounds can be emphasized.

Usage Example 1

Next, a usage example of the audio apparatus 1 will be described. The audio apparatus 1 mixes sung vocals received by the microphone unit 100 with a karaoke accompaniment sound and emits in-phase sounds from the first speaker SP1 and the second speaker SP2. In the audio apparatus 1, the in-phase sounds are canceled at the diaphragm of the microphone unit 100 for reducing howling noise. Another technology in which an in-vehicle microphone and in-vehicle speakers are utilized is a hands-free telephone. The reduction of howling noise is important also in this technology. The audio apparatus 1 can be utilized in an in-vehicle hands-free telephone.

Figure 15:
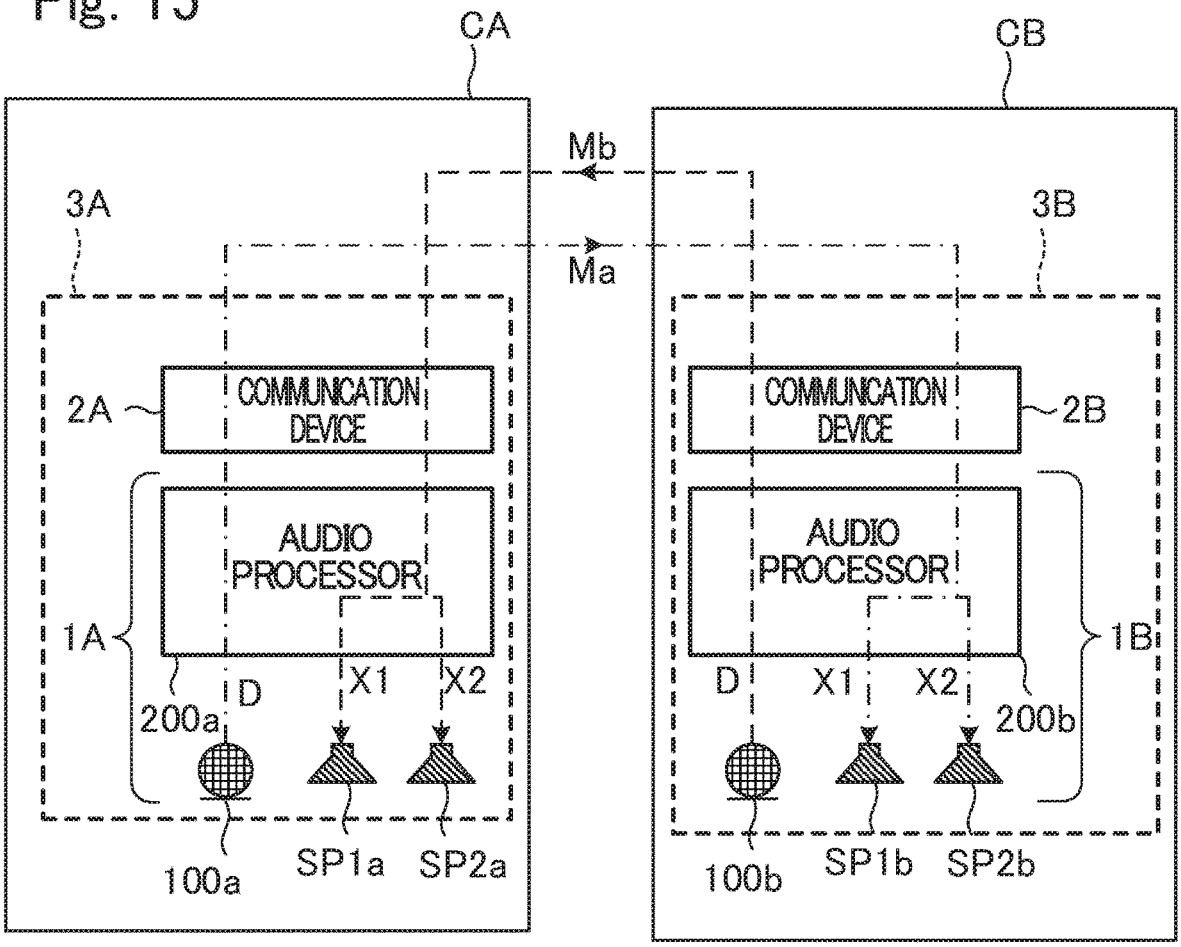
FIG. 15 is a view showing a usage example of the audio apparatus.

For example, as shown in FIG. 15, the vehicles CA and CB include hands-free telephone apparatuses 3A and 3B, respectively. Let us assume that a user A manipulates the telephone apparatus 3A in the vehicle CA and another user B manipulates the telephone apparatus 3B in the vehicle CB. The telephone apparatus 3A includes an audio apparatus 1A, a communication device 2A, a first speaker SP1*a*, a second speaker SP2*a*, and a microphone unit 100*a*. The telephone apparatus 3B includes an audio apparatus 1B, a communication device 2B, a first speaker SP1*b*, a second speaker SP2*b*, and a microphone unit 100*b*. In the same manner as to the above-described embodiment, each of the microphone units 100*a* and 100*b* has the bidirectional characteristic. The distance from the first speaker SP1*a* to the microphone unit 100*a* is substantially equal to the distance from the second speaker SP2*a* to the microphone unit 100*a*. The distance from the first speaker SP1*b* to the microphone unit 100*b* is also substantially equal to the distance from the second speaker SP2*b* to the microphone unit 100*b*. Each of the audio apparatuses 1A and 1B has a structure similar to that of the above-described audio apparatus 1. The audio processor 200*a* in the audio apparatus 1A conducts signal processing on the output signal D of the microphone unit 100*a*, and supplies the resulting audio signal as a first signal Ma to the communication device 2A. The communication device 2A sends the first signal Ma to the telephone apparatus 3B, which is an external apparatus for the telephone apparatus 3A. The communication device 2A also receives a second signal Mb from the telephone apparatus 3B and supplies it to the audio processor 200*a*. The audio processor 200*a* conducts signal processing on the second signal Mb, and produces a first audio signal X1 and a second audio signal X2 that is in-phase with the first audio signal X1, supplies the first audio signal X1 to the first speaker SP1*a*, and supplies the second audio signal X2 to the second speaker SP2. The audio processor 200*a* of this example does not mix the output signal D and the second signal Mb received from the telephone apparatus 3B, and therefore, the audio processor 200*a* is different from the audio processor 200 of the above-described embodiment in this respect.

The telephone apparatus 3B is constructed in the same way as the telephone apparatus 3A. Therefore, the audio processor 200*b* of the audio apparatus 1B does not mix the output signal D with the first signal Ma received from the telephone apparatus 3A. The audio apparatus 1B serves as an external apparatus in relation to the audio apparatus 1A. Accordingly, the microphone unit 100*b* serves as an external microphone of the audio apparatus 1B, whereas the first speaker SP1*b* and the second speaker SP2*b* serve as external speakers of the audio apparatus 1B.

In the in-vehicle hands-free telephone system having the telephone apparatus 3A and telephone apparatus 3B, the voice of the user B circulates in the following path: from the microphone unit 100*b* of the telephone apparatus 3B, via the communication device 2B, the communication device 2A, and the first and second speakers SP1*a* and SP2*a* of the audio apparatus 1A, to the microphone unit 100*a* of the audio apparatus 1A. The sound fed back in this path causes howling noise. However, the sounds emitted from the first speaker SP1*a* and the second speaker SP2*a* are canceled at the bidirectional microphone unit 100*a*, so that howling noise can be reduced. For the voice of the user A, since the sounds emitted from the first speaker SP1*b* and the second speaker SP2*b* are canceled at the bidirectional microphone unit 100*b* in the same manner as that for the voice of the user B, howling noise can also be reduced.

Usage Example 2

Figure 16:
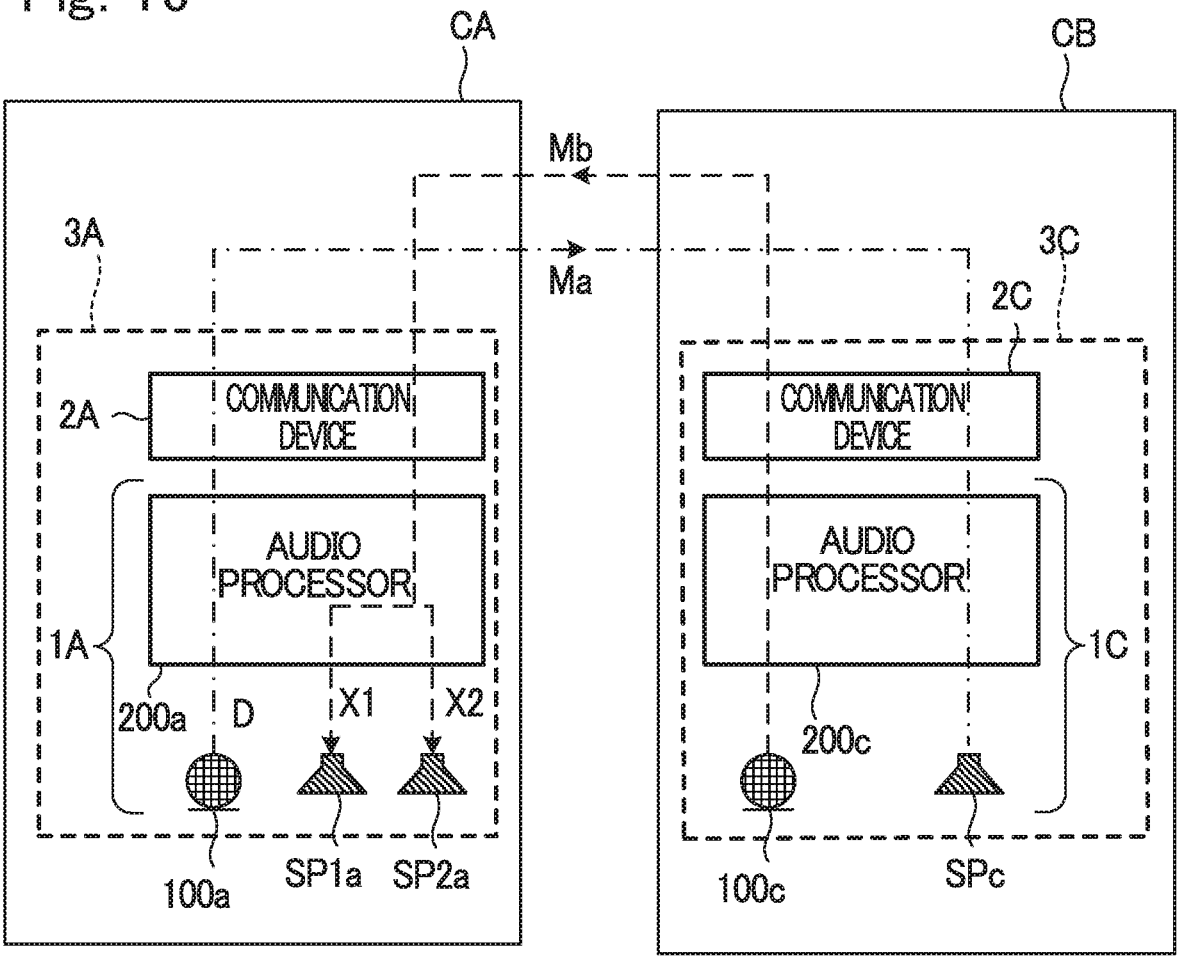
FIG. 16 is a view showing another usage example of the audio apparatus.

Usage Example 2 is an application in which the above-described audio apparatus 1 is used in a hands-free telephone system similar to in Usage Example 1. As shown in FIG. 16, the vehicles CA and CB include hands-free telephone apparatuses 3A and 3C, respectively. Let us assume that a user A manipulates the telephone apparatus 3A in the vehicle CA and another user B manipulates the telephone apparatus 3C in the vehicle CB. The hands-free telephone apparatus 3C in this example is a mobile phone set. FIG. 16 shows a block diagram of a communication system. The telephone apparatus 3C includes an audio apparatus 1C, a communication device 2C, and a speaker SPc. The audio apparatus 1C includes a microphone 100*c* and an audio processor 200*c*. The audio apparatus 1C serves as an external apparatus in relation to the audio apparatus 1A, the speaker Spc serves as an external speaker, and the microphone 100*c* as an external microphone. The microphone 100*c* is aimed to be located near the mouth of the user B, whereas the speaker SPc is aimed to be located near either of the ears of the user B. Accordingly, the sound emitted from the speaker SPc is not input to the microphone 100*c*. The audio processor 200*c* supplies a second signal Mb supplied from the microphone 100*c* to the communication device 2C. The communication device 2C transmits the second signal Mb to the hands-free telephone apparatus 3A. The communication device 2C also receives the first signal Ma, and supplies it to the audio processor 200*c*. The audio processor 200*c* conducts signal processing on the first signal Ma, and then supplies the resulting signal to the speaker SPc.

In the communication system having the telephone apparatus 3A and telephone apparatus 3C, the voice of the user A is sent in the following path: from the microphone unit 100*a* of the telephone apparatus 3A, via the communication device 2A and the communication device 2C of the telephone apparatus 3C, to the speaker SPc of the audio apparatus 1C. Since the sound emitted from the external speaker SPc is not input to the microphone 100*c*, the voice of the user A does not return from the telephone apparatus 3C to the telephone apparatus 3A. Thus, the voice of the user A does not circulate. On the other hand, the voice of the user B does not circulate for the same reason described in conjunction with Usage Example 1. Accordingly, if the telephone apparatus 3C is a mobile phone set or has a structure in which the voice output from the speaker is not input to the microphone as in a land-line phone, it is possible to prevent the voice of the user B from returning from the telephone apparatus 3A to the telephone apparatus 3C, and from being heard by the user of the telephone apparatus 3C.

Modifications

The above-exemplified embodiments may be variously modified. Exemplary specific modes of modification are described below. Two or more modes freely selected from the following modifications may be appropriately combined unless they conflict.

(1) In order to enhance the reduction effect of howling noise, signal processing performed by the audio processor 200 may include a well-known cancelling process using an adaptive filter and/or a notch filter.

(2) In the above-described embodiment, the audio apparatus 1 includes a microphone unit 100 having a bidirectional characteristic by which a unidirectional microphone 3 is held in a case 2 having a first opening S1 and a second opening S2. However, the present invention does not exclude use of a bidirectional microphone, and therefore, a bidirectional microphone may be substituted for the unidirectional microphone 3.

(3) In the above-described embodiment, the audio apparatus 1 is used for an in-vehicle karaoke system, whereas in the usage examples, the audio apparatus 1 is used for an in-vehicle hands-free telephone system. The use of the audio apparatus 1 is not limited to in-vehicle systems. For example, the audio apparatus 1 may be utilized for another karaoke system and/or another hands-free telephone that are located and used in a lounge of a house or other environment.

(4) As described above, the first audio signal X1 and the second audio signal X2 may be either of stereo signals or monaural signals. In a case in which the external signal Q supplied to the audio processor 200 is a stereo signal, the first audio signal X1 and the second audio signal X2 are stereo signals. On the other hand, in a case in which the external signal Q supplied to the audio processor 200 is a monaural signal, the first audio signal X1 and the second audio signal X2 are monaural signals. In a case in which the first audio signal X1 and the second audio signal X2 are stereo signals, the reduction effect of howling noise is weaker in comparison with the case in which they are monaural signals. Accordingly, the following functions may be given to the audio processor 200. The audio processor 200 may include a signal converter for converting the external signal Q into a monaural signal in a case in which the external signal Q supplied to the audio processor 200 is a stereo signal. The signal converter may convert the stereo signal to a monaural signal by instructions given by user input. Alternatively, the signal converter may convert the stereo signal to a monaural signal automatically. Furthermore, the signal converter may convert the stereo signal to a monaural signal automatically if the signal levels of the first audio signal X1 and the second audio signal X2 are equal to, or greater than, a reference value.

Aspects of Invention

From the above-described embodiment, the modifications, and variations, preferred aspects of the present invention are understood as follows.

In one aspect, an audio apparatus includes: a bidirectional microphone unit located at a position, a distance from a first speaker to the position being substantially equal to a distance from a second speaker to the position; and an audio processor adapted to conduct signal processing on a signal output from the microphone unit for producing audio signals, and for supplying the audio signals to the first speaker and the second speaker. According to this aspect, if the first speaker and the second speaker emit in-phase sounds, the sounds are substantially canceled on the diaphragm of the microphone unit, the microphone unit can supply an audio signal with fewer components corresponding to the sounds emitted by the first speaker and the second speaker.

In a preferred mode of the above audio apparatus, the microphone unit may preferably include: a case having an interior space; a unidirectional microphone held in the interior space of the case; a first opening provided in the case; and a second opening provided in the case, the first opening and the second opening arranged opposite to each other across the microphone and arranged in a straight line parallel to an axis of sensitivity of the microphone. According to this mode, in comparison with a case in which a bidirectional microphone is used for the microphone unit, the sounds emitted from the first and the second speaker can be canceled adequately even if the audio apparatus is used in an environment in which there are objects influencing the diffraction of sounds.

In a particularly preferable mode, the case may include a main body and a lid. The main body may include a bottom part, a wall part surrounding peripheries of the bottom part, a holder holding the microphone and dividing a space defined by the bottom part and the wall part into two spaces, and a third opening at a side opposite to the bottom part, with the lid covering a part of the third opening of the main body and being in contact with the holder. The first opening may be a part of the third opening and be a gap between the lid and the wall part located at a first side in a longitudinal direction of the main body, and the second opening may be a part of the third opening and be a gap between the lid and the wall part located at a second side in the longitudinal direction of the main body, with the second side being opposite to the first side.

In an even more preferred mode of the audio apparatus, a distance between the first opening and the second opening may be equal to or greater than 10 mm and equal to or less than 40 mm. In other words, the double of the length of each of the spreading sections 421 and 422 is preferably equal to or greater than 10 mm and equal to or less than 40 mm. In the above-described audio apparatus, there is formed in the microphone unit a Helmholtz resonator in which the first opening serves as the resonator neck, and another Helmholtz resonator in which the second opening serves as the resonator neck. The cavity sizes of the Helmholtz resonators are determined depending on the distance between the first opening and the second opening. If the distance between the first opening and the second opening is less than 10 mm, it is impossible to ensure sufficiently sized cavities for achieving the functions of the Helmholtz resonators. On the other hand, if the distance between the first opening and the second opening is greater than 40 mm, the microphone unit 100 is too large to be located in the vicinity of the compartment lamp. Thus, the distance between the first opening and the second opening is preferably equal to or greater than 10 mm and equal to or less than 40 mm.

In still another preferred mode of the audio apparatus, the audio signals may include a first audio signal and a second audio signal that is in-phase with the first audio signal, with the first audio signal being supplied to the first speaker and the second audio signal being supplied to the second speaker. According to this mode, it is possible to avoid the sounds emitted from the first and second speakers from returning to the first and second speakers via the microphone unit and the audio processor, so that howling noise can be reduced.

In a particularly preferred mode, the audio processor may be configured to mix a signal output from the microphone unit with an external signal, thereby producing the first audio signal and the second audio signal. According to this mode, the first speaker and the second speaker are provided with the first audio signal and the second audio signal resulting from mixing the signal output from the microphone unit with the external signal. Since the distance from the first speaker to the microphone unit is substantially equal to the distance from the second speaker to the microphone unit, the sound from the first speaker and the sound from the second speaker are canceled at the bidirectional microphone unit. Accordingly, the microphone unit can convert substantially only the user's voice to an electrical signal. As a result, howling noise can be reduced in, for example, a karaoke system or a hands-free telephone system.

In another aspect, an audio apparatus includes: a bidirectional microphone unit located at a position, a distance from a first speaker to the position being substantially equal to a distance from a second speaker to the position; and an audio processor connected with a communication device that sends a first signal to be supplied to the external speaker to an external apparatus including an external speaker and an external microphone, with the communication device receiving a second signal from the external apparatus, with the second signal being output from the external microphone. The audio processor is configured to: conduct signal processing on a signal output from the microphone unit for producing an audio signal; supply the audio signal as the first signal to the communication device; conduct signal processing on the second signal supplied from the communication device for producing a first audio signal and a second audio signal that is in-phase with the first audio signal, to supply the first audio signal to the first speaker; and supply the second audio signal to the second speaker. According to this aspect, when a user speaks using the audio apparatus, the user's voice is received by the microphone unit, and is sent as the first signal to the other party's external apparatus. On the other hand, the other party's voice is converted by the external microphone to the second signal, based on which the audio processor produces the first audio signal and the second audio signal to generate the other party's voice, so that the voice can be heard by the user. In this aspect, the sounds derived from the other party's voice emitted from the first speaker and the second speaker are canceled at the bidirectional microphone unit, so that howling noise can be reduced.

DESCRIPTION OF REFERENCE SIGNS

1 . . . audio apparatus; 100 . . . microphone unit; 100*c* . . . microphone (external microphone); 200 . . . audio processor; 2 . . . case; 2*a* . . . communication device; 3 . . . microphone; 10 . . . main body; 11 . . . bottom part; 12 . . . through-hole; 13 . . . groove; 20 . . . holder; 21 . . . through-hole; 22 . . . hole; 40 . . . lid; 411 . . . hook; 421, 422 . . . spreading section; 111 . . . first wall; 112 . . . second wall; 113 . . . third wall; 114 . . . fourth wall; D1 . . . first direction; D2 . . . second direction; S1 . . . first opening; S2 . . . second opening; SP1 . . . first speaker; P2 . . . second speaker; SPc . . . speaker (external speaker).

What is claimed is:

1. A microphone unit comprising:

a case having an interior space;

a microphone held in the interior space of the case;

a first opening provided in the case; and a second opening provided in the case, wherein the first opening and the second opening are arranged opposite to each other across the microphone and are arranged in a straight line parallel to an axis of sensitivity of the microphone, wherein the case comprises a main body and a lid, wherein the main body comprises:

a bottom part;

a wall part surrounding peripheries of the bottom part;

a holder holding the microphone and dividing the interior space into two spaces, wherein the interior space is defined by the bottom part and the wall part; and a third opening at a side opposite to the bottom part, wherein the lid covers a part of the third opening of the main body and is in contact with the holder, wherein the first opening is a part of the third opening and is a gap between the lid and the wall part located at a first side in a longitudinal direction of the main body, and wherein the second opening is a part of the third opening and is a gap between the lid and the wall part located at a second side in the longitudinal direction of the main body, the second side being opposite to the first side.

2. The microphone unit according to claim 1, wherein a distance between the first opening and the second opening is equal to or greater than 10 mm and equal to or less than 40 mm.

3. An audio apparatus comprising:

the microphone unit according to claim 1; and an audio processor configured to conduct signal processing on a signal output from the microphone unit for producing audio signals, and to supply the audio signals to the first speaker and the second speaker, wherein the microphone unit is located at a position, a distance from a first speaker to the position being substantially equal to a distance from a second speaker to the position.

4. The audio apparatus according to claim 3, wherein the audio signals include a first audio signal and a second audio signal that is in-phase with the first audio signal, and wherein the first audio signal is supplied to the first speaker, and the second audio signal is supplied to the second speaker.

5. The audio apparatus according to claim 4, wherein the audio processor is configured to mix a signal output from the microphone unit with an external signal, thereby producing the first audio signal and the second audio signal.

6. An audio apparatus comprising:

the microphone unit according to claim 1; and an audio processor connected with a communication device, wherein the communication device sends a first signal to an external apparatus comprising an external speaker and an external microphone, the first signal being supplied to the external speaker, and the communication device receives a second signal from the external apparatus, the second signal being output from the external microphone, wherein the microphone unit is located at a position, a distance from a first speaker to the position being substantially equal to a distance from a second speaker to the position, and wherein the audio processor is configured to:

conduct signal processing on a signal output from the microphone unit for producing an audio signal;

supply the audio signal as the first signal to the communication device;

conduct signal processing on the second signal supplied from the communication device for producing a first audio signal and a second audio signal that is in-phase with the first audio signal;

supply the first audio signal to the first speaker; and supply the second audio signal to the second speaker.

* * * * *